US008205677B1

(12) United States Patent
Salkin

(10) Patent No.: US 8,205,677 B1
(45) Date of Patent: Jun. 26, 2012

(54) SYSTEM AND METHOD FOR CONTROLLING UNDERWATER OIL-WELL LEAK

(76) Inventor: Samuel Salkin, San Clemente, CA (US)

( * ) Notice: Subject to any disclaimer, the term of this patent is extended or adjusted under 35 U.S.C. 154(b) by 0 days.

(21) Appl. No.: 13/171,159

(22) Filed: Jun. 28, 2011

Related U.S. Application Data

(60) Provisional application No. 61/359,250, filed on Jun. 28, 2010.

(51) Int. Cl.
*E21B 33/12* (2006.01)

(52) U.S. Cl. ..... 166/363; 166/364; 166/386; 166/192; 138/89

(58) Field of Classification Search ..... 166/363, 166/339, 364, 368, 285, 381, 386, 387, 75.15, 166/179, 192, 193; 138/89
See application file for complete search history.

(56) References Cited

U.S. PATENT DOCUMENTS

| | | | | | |
|---|---|---|---|---|---|
| 2,754,910 | A | * | 7/1956 | Derrick et al. | 166/284 |
| 2,796,937 | A | * | 6/1957 | Haines et al. | 166/147 |
| 3,376,934 | A | * | 4/1968 | William et al. | 166/193 |
| 3,472,285 | A | * | 10/1969 | Pennington et al. | 138/97 |
| 3,623,550 | A | * | 11/1971 | de Lajarte et al. | 166/125 |
| 3,647,000 | A | * | 3/1972 | Rowley et al. | 166/285 |
| 3,926,256 | A | * | 12/1975 | McCall | 166/285 |
| 4,187,909 | A | * | 2/1980 | Erbstoesser | 166/284 |
| 4,194,561 | A | * | 3/1980 | Stokley et al. | 166/162 |
| 4,195,690 | A | * | 4/1980 | Erbstoesser et al. | 166/281 |
| 4,333,643 | A | * | 6/1982 | Saffire | 482/20 |
| 4,336,843 | A | * | 6/1982 | Petty | 166/353 |
| 4,369,845 | A | * | 1/1983 | Henson et al. | 166/298 |
| 4,378,838 | A | * | 4/1983 | Ogden et al. | 166/153 |
| 4,404,053 | A | * | 9/1983 | Saffire | 156/86 |
| 4,417,624 | A | * | 11/1983 | Gockel | 166/351 |
| 4,417,625 | A | * | 11/1983 | Henson et al. | 166/387 |
| 4,582,091 | A | * | 4/1986 | Ells | 138/97 |
| 5,829,523 | A | * | 11/1998 | North | 166/250.14 |
| 5,967,236 | A | * | 10/1999 | Parker | 166/386 |
| 6,431,273 | B1 | * | 8/2002 | McGarian et al. | 166/183 |
| 6,595,297 | B2 | * | 7/2003 | Dallas | 166/382 |
| 6,715,541 | B2 | * | 4/2004 | Pedersen et al. | 166/75.15 |
| 6,776,228 | B2 | * | 8/2004 | Pedersen et al. | 166/75.15 |
| 6,973,966 | B2 | * | 12/2005 | Szarka | 166/153 |
| 7,506,686 | B2 | * | 3/2009 | Szarka | 166/192 |
| 7,527,095 | B2 | * | 5/2009 | Bloess et al. | 166/265 |
| 7,540,326 | B2 | * | 6/2009 | Rytlewski | 166/297 |
| 7,559,363 | B2 | * | 7/2009 | Howell et al. | 166/153 |
| 7,607,481 | B2 | * | 10/2009 | Barbee | 166/291 |
| 7,637,323 | B2 | * | 12/2009 | Schasteen et al. | 166/318 |
| 7,647,962 | B2 | * | 1/2010 | Ruggeri et al. | 166/108 |
| 7,673,688 | B1 | * | 3/2010 | Jones et al. | 166/311 |
| 7,841,410 | B2 | * | 11/2010 | Barbee | 166/291 |
| 2008/0066924 | A1 | * | 3/2008 | Xu | 166/376 |
| 2011/0290501 | A1 | * | 12/2011 | Duncan et al. | 166/363 |
| 2011/0303416 | A1 | * | 12/2011 | Herman, II | 166/350 |
| 2012/0000666 | A1 | * | 1/2012 | Cochrane | 166/363 |
| 2012/0018174 | A1 | * | 1/2012 | Kotefski et al. | 166/386 |

* cited by examiner

*Primary Examiner* — Matthew Buck
(74) *Attorney, Agent, or Firm* — Vista IP Law Group LLP

(57) ABSTRACT

A first method of controlling underwater oil well leaks is to place heavy metal javelins into the ruptured pipe. A second method is to fabricate or drop a series of self-stacking exterior collars around or over the ruptured pipe.

9 Claims, 4 Drawing Sheets

SYSTEM AND METHOD FOR CONTROLLING UNDERWATER OIL-WELL LEAK

RELATED APPLICATION

This application claims the benefit of provisional patent application Ser. No. 61/359,250, filed Jun. 28, 2010, the contents of which are incorporated herein by reference. Priority is claimed pursuant to 35 U.S.C. §119.

BACKGROUND

The invention relates to underwater oil wells, and specifically to methods for controlling underwater oil well leaks. In April 2010, the Deepwater Horizon oil rig in the Gulf of Mexico exploded, caught fire, and soon sank. Shortly thereafter it was reported oil was leaking from the rig. Various reports estimated the rate of flow of the leak was anywhere from 35,000 to 80,000 barrels of crude oil per day. As of the date of the filing of the above-referenced provisional patent application, various methods had been considered to stop the oil flow, but the methods were either rejected, or tried and failed. The methods included: 1) the "top kill" which involved pumping tons of mud into the ruptured pipe; 2) the "junk shot" which involved jamming up the pipe with huge amounts of golf balls and other trash; 3) containing the leak by placing a containment chamber over the ruptured pipe and then pumping the captured oil to the surface (and in one alternative injecting methanol into the chamber to heat the water so as to limit the creation of crystals that had caused a previous containment attempt to fail); and 4) reinserting a tube into the well's riser stack to siphon the oil back top the surface. Yet as of that date, the oil continued to leak. There thus is a great need for methods to contain, reduce, and/or stop underwater oil leaks.

SUMMARY

In one aspect of the present invention, an underwater oil well leak from an underwater oil well pipe is controlled by providing a plurality of heavy metal javelins, and placing the javelins into an opening in the pipe. Each of the javelins has a tapered distal end, and a length greater than the maximum diameter of the oil well pipe. The javelins are placed into the pipe opening tapered-end first. In one embodiment, the javelins are made of mostly lead. In one embodiment, the length of the tapered end of each javelin is between approximately one fourth and approximately one third the length of the non-tapered proximal end. In one embodiment the maximum transverse diameter of each javelin is between approximately 1.0 inch and approximately 1.5 inches. In one embodiment the maximum transverse diameter of each javelin is between approximately one fifth and one fourth of the maximum diameter of the pipe. In one embodiment the javelins are placed in an opening near the top of the pipe. In one embodiment, the javelins are dropped into the pipe, and in one embodiment this is done one at a time. In one embodiment, the javelins are dropped into the pipe until at least some of them come to rest at approximately the same level as the bottom of the pipe.

In one aspect of the present invention, an underwater oil well leak from an underwater oil well pipe is controlled by providing a plurality of collars for encasing a length of the pipe, placing a first collar around the pipe such that it slides down a portion of the pipe, and placing a second collar around the pipe above the first collar such that the second collar comes to rest upon the first collar. Each collar has an open top and open bottom, a metal collar portion, and a flotation portion, the bottom end of the flotation portion being attached to the top end of the metal collar portion. The bottom end of the metal collar portion has a first mechanical joint configured to mate with the top end of the flotation portion (of another collar) so the collars can be stacked on top of each other for storage and for usage. In one embodiment additional collars are placed around the underwater pipe in succession, each one on top of the previously-placed one such that each successive one comes to rest upon the previously-placed one, the first mechanical joint of each successive collar mating with the second mechanical joint of the corresponding previously-placed collar, to extend the length of the column of collars by one collar-length for each additional collar so placed. Each collar has a specific gravity greater than 1.0. In one embodiment, each of the collars has a substantially identical specific gravity. In one embodiment, the quantity of collars placed over or around the pipe is sufficient to force the first collar to a depth at or below the leak, and in one embodiment the first collar is forced all the way down to the floor of the ocean (or other body of water in which the pipe resides).

In one embodiment of the present invention, the collar has a specific gravity less than approximately 1.10, and in one embodiment the collar has a specific gravity between approximately 1.0 percent greater than the specific gravity of seawater and approximately 2.0 percent greater than the specific gravity of seawater. In one embodiment, the metal collar portion and flotation portion each have substantially circular transverse external cross-sections. In one embodiment, the metal collar portion and the flotation portion each have substantially circular transverse internal cross-sections. In one embodiment, the metal collar portion comprises mostly stainless steel, and in another the metal collar portion comprises mostly carbon-steel. In one embodiment, the flotation portion comprises mostly polyurethane. The floatation portion may comprise any other suitable floatation material.

In one aspect of the present invention, the collar has an open top and an open bottom, an inner core metal collar portion having an outer surface, and an outer skin flotation portion having an inner surface, the inner surface of the outer skin being attached to the outer surface of the inner core metal collar portion.

BRIEF DESCRIPTION OF THE DRAWINGS

The foregoing and other aspects of embodiments are described in further detail with reference to the accompanying drawings, wherein:

FIG. 3 is a diagram showing embodiments of collars of the present invention being used to control an underwater leak according to one embodiment of the present invention, wherein

DETAILED DESCRIPTION OF ILLUSTRATED EMBODIMENTS

Figure 1A:
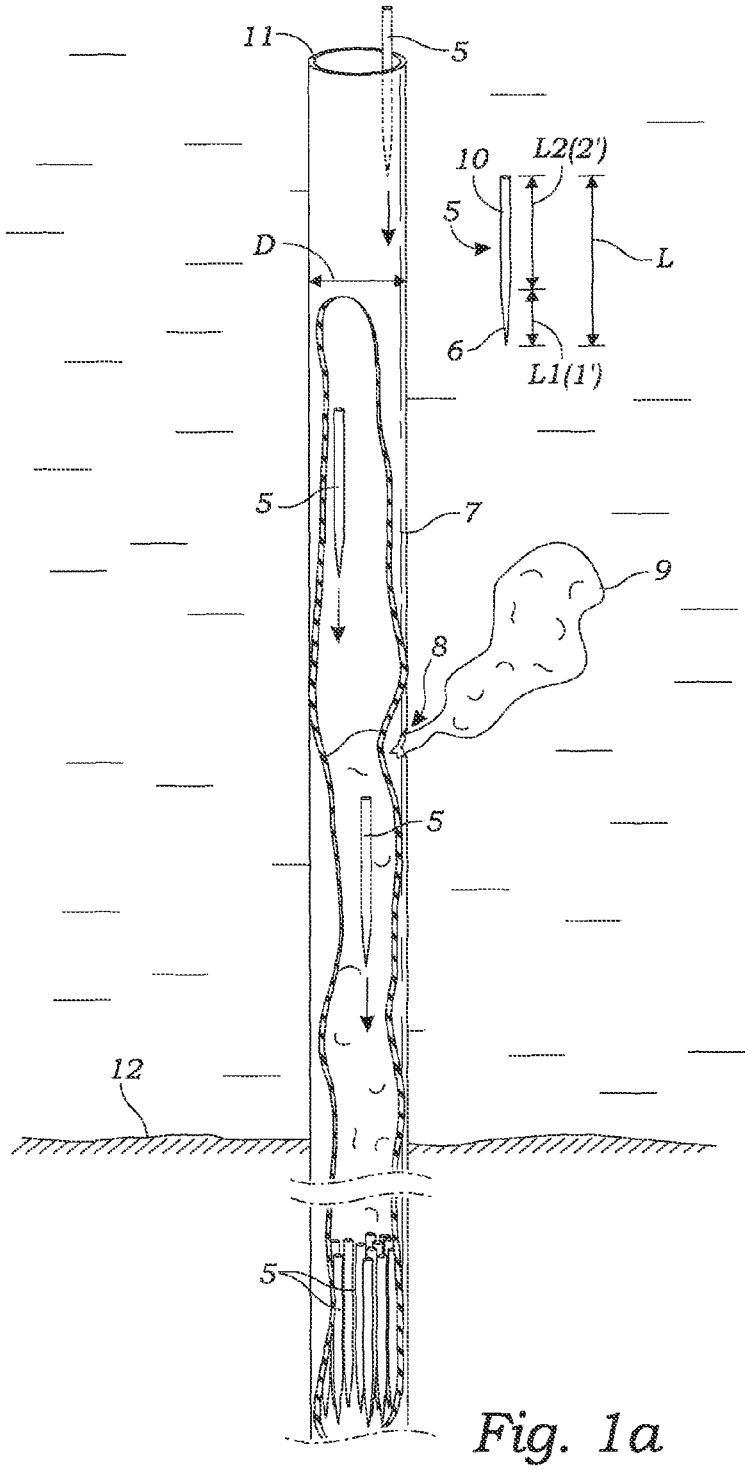
FIG. 1*a* is a diagram (including a partial cutout cross-section of the oil well pipe) showing javelins plugging up an underwater oil leak according to one embodiment of the present invention.
Figure 1B:
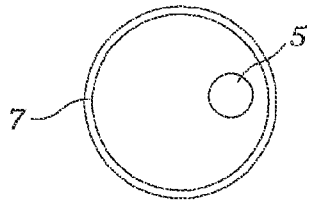
FIG. 1*b* is a top view of the oil well pipe of FIG. 1*a;*

Turning first to FIG. 1, a diagram shows javelins 5 plugging up an underwater oil well leak according to one embodiment of the present invention. The word "javelin" is used herein to mean a spear-like item with a pointed or tapered end 6. The idea is basically to get a bunch of javelins 5 down into a ruptured underwater oil well pipe 7 to plug the well. In order to travel down the pipe 7, the javelins 5 should be heavy enough to overcome all upward forces, including frictional forces of the oil 9 gushing upward. By shaping the items as javelins 5, and placing them into the pipe 7 point-first, this minimizes the upward frictional forces due primarily to reduced surface area of the javelin 5 (i.e. the point) at its orientation orthogonal to the upward forces. Polishing the javelins 5 will also help reduce skin friction. The javelins 5 should have a length L greater than the maximum diameter D of the oil well pipe 7, so as they travel down the pipe 7 they cannot get oriented in a manner to substantially increase the downward facing surface area. Also, it is envisioned the javelins 5 should not get oriented during their downward travels so as to get stuck in the pipe 7 above the point of rupture 8. However, if the javelins 5 did get stuck in the pipe 7, this too would suffice to plug the leak, so long as the "traffic jam" of javelins 5 was below the rupture point 8. To stop the flow of oil 9, the combined pressure of the water above the javelins 5 and the accumulated weight of the javelins 5 must exceed the upward pressure of the escaping oil 9. It is estimated approximately 500 to 1000 javelins 5 would be required to stop the current Deepwater Horizon oil well leak.

Dart-shaped spears or other similar plugging items may be used, but javelins 5 having a substantially uniform taper 6 are preferred. Polished heavy metal is preferred for the javelins 5, to increase the downward forces thereof and to also help overcome any upward forces and thus allow the javelins 5 to reach their target, e.g., the bottom of the pipe 7 or anywhere below the rupture point 8. It is recommended the javelins 5 be made of mostly lead, since lead is very heavy. It is also recommend the javelins 5 be polished to reduce the skin friction.

The length L1 of the tapered (distal) end 6 of the javelins 5 should be between approximately one fourth and approximately one third the length L2 of the proximal end 10. For example, as seen in FIG. 1*a*, the tapered (distal) end 6 is 1 foot long, whereas the proximal end 10 is 2 feet long. The proximal end 10 is shown as blunt in FIG. 1, but it may be tapered or pointed also. The maximum transverse diameter of each javelin 5 should be between approximately 1.0 inch and approximately 1.5 inches, and should be between approximately one fifth the maximum diameter D of the underwater pipe 7 and approximately one fourth the maximum diameter D of the underwater pipe 7, also to reduce the upward frictional forces as the javelins 5 travel down the pipe 7.

FIG. 1 shows the javelins 5 entering the underwater pipe 7 from an opening 11 at the top of the pipe 7. But the opening may be anywhere in the pipe 7, including the point of rupture 8, or a secondary opening made specifically for deploying the javelins 5. In the latter case, it may be advantageous to create an opening at a point lower on the pipe 7 than the rupture 8, if, for example, debris exists in the pipe 7 above the rupture 8 that might prevent the javelins 5 from reaching their target. Also, although dropping the javelins 5 into the pipe 7 is one method of deploying them, they may also be shot into the pipe 7 using a launching mechanism, or placed into the pipe 7 in any other manner. Likewise, they may be placed in the pipe 7 one at a time, or placed in the pipe 7 more than one at a time.

FIG. 1 shows the javelins 5 making their way all the way to a point below the ocean floor 12, to actually plug the well. This is ideal, and in fact in one embodiment of the present invention the javelins 5 are put into the underwater oil well pipe 7 until at least some of them come to rest at approximately the level of the floor 12 of the ocean (or other body of water). In some instances multiple layers of stacked javelins 5 may be required to plug the well.

Figure 2:
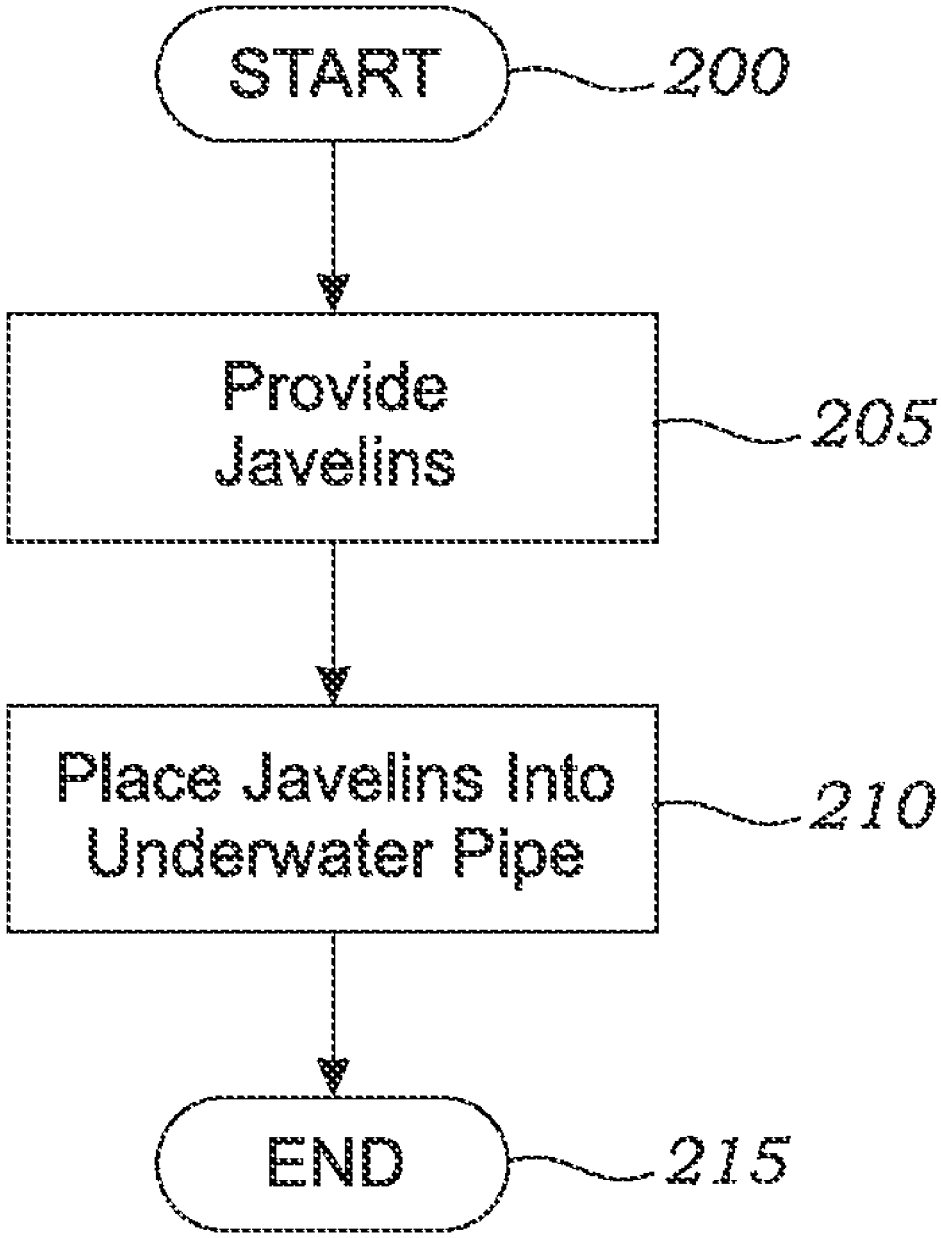
FIG. 2 is a flow diagram showing a method of using javelins to plug up an underwater oil leak according to one embodiment of the present invention.

Turning briefly to FIG. 2, a flow diagram shows a method of using javelins to plug up an underwater oil leak according to one embodiment of the present invention. The method begins at Step 200, and at Step 205 javelins (as described herein) are provided. This may be as simple as the javelins being present, or as complex as the user actually manufacturing the javelins. Once the javelins are present, at Step 210 they are placed into the underwater pipe as described herein. The process of placing javelins into the pipe continues until the leak is plugged or at least substantially reduced. The method ends at Step 215.

Figure 3C:
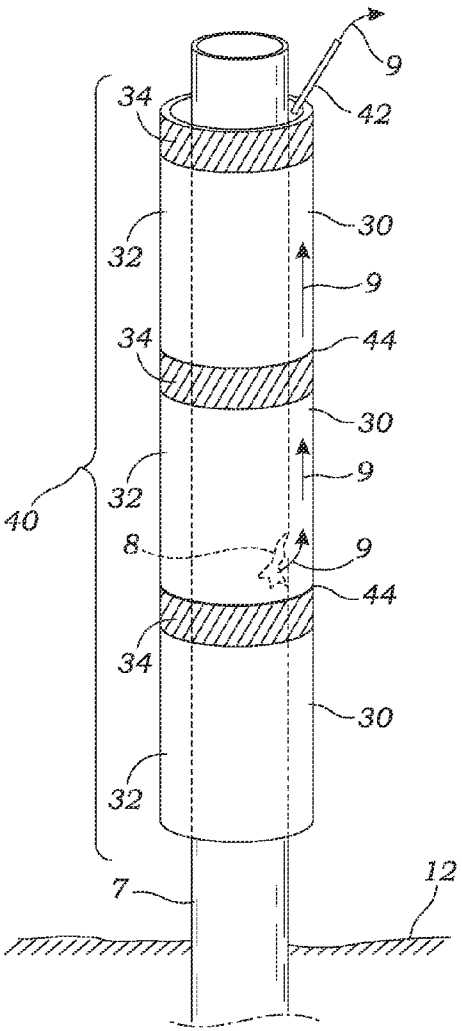
FIG. 3*c* shows the collars of FIG. 3*b* in use.
Figure 3B:
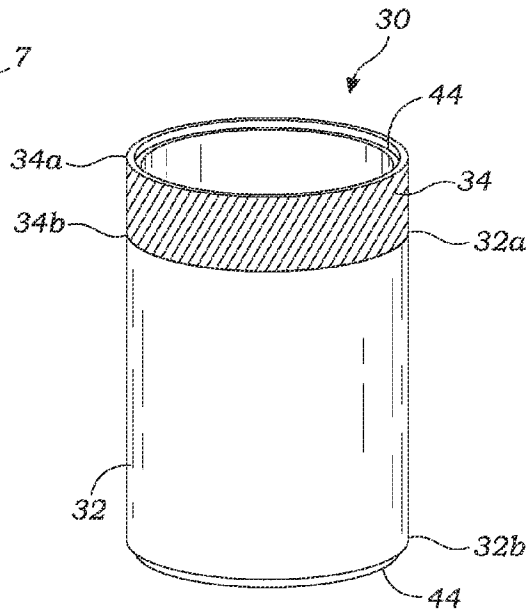
FIG. 3*b* shows a side view of another embodiment.
Figure 3A:
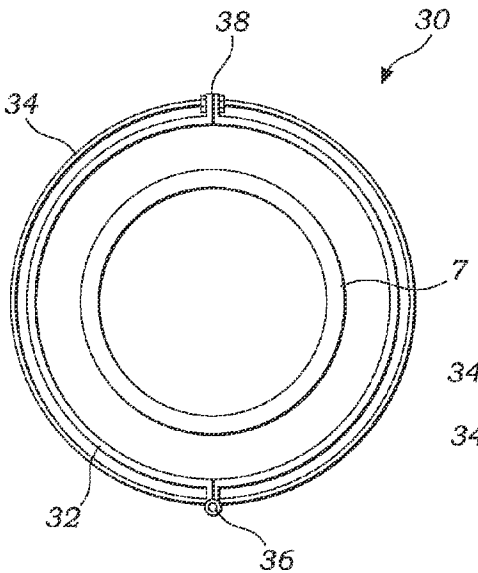
FIG. 3*a* shows a top view of one embodiment.

Turning now to FIG. 3, the collar method is shown in which multiple collars 30 are placed over or around the oil well pipe 7 to form a column 40 of collars 30 surrounding a length of the pipe 7 at least as far down as the rupture point 8 in the pipe 7. FIG. 3*a* shows an embodiment with an inner core metal collar portion 32 having an outer surface, and an outer skin flotation portion 34 having an inner surface, the inner surface of the outer skin 34 being attached to the outer surface of the inner core metal collar portion 32. FIG. 3*b* shows an embodiment with the bottom end 34*b* of the flotation portion 34 being attached to the top end 32*a* of the metal collar portion 32, the bottom end 32*b* of the metal collar portion 32 having a first mechanical joint 44 configured to mate with the top end 34*a* of the flotation portion 34 (of another collar 30). In this embodiment, the collars 30 are placed over the top of the pipe 7 so the collars 30 can slide down the pipe 7.

In one embodiment, the collars 30 are placed over the top of the pipe 7 so the collars 30 can slide down the pipe 7. In another embodiment, as seen e.g., in FIG. 3*a*, the collars 30 have a hinge 36 and joint 38 so they may be opened and closed like a clamshell. This latter embodiment may be used to place the collars 30 around a portion of the pipe 7 instead of sliding them over the top.

As seen in FIG. 3*c*, as collars 30 are placed over or around the pipe 7 one on top of another, they form a column 40 of collars 30. Once the column 40 covers the rupture point 8, the oil (indicated by arrows 9) will flow up the radially formed cavity between the outer wall of the pipe 7 and the inner walls of the collars 30, to the top of the column 40 where the oil 9 may then be recovered as represented by recovery siphon 42. Ideally the top of the column 40 is at or near the surface of the water. Covering the rupture point 8 may require stacking enough collars 30 to rise up from the ocean floor 12, or it may require submerging enough collars 30 to reach down to the rupture point 8 yet not extend all the way to the floor 12. The latter may be possible if the collars 30 are designed with a specific gravity only slightly greater than the water in which the well resides.

The collars 30 preferably have mechanical joints 44 at their top and bottom portions. Specifically, as seen in the embodiment shown in FIG. 3*b*, the metal collar portion 32 has a top end 32*a* and a bottom end 32*b*, and the bottom end 32*b* has a first mechanical joint 44. The flotation portion 34 has a top end 34*a* and a bottom end 34*b*, and the bottom end 34*b* is attached to the top end 32*a* of the metal collar portion 32. The top end 34*a* of the flotation portion 34 has a second mechanical joint 44 structured to mate with a mechanical joint 44 structured similar to the first mechanical joint 44, so that the collars 30 can be stacked on top of each other for storage and usage. The joints 44 may be any suitable joints sufficient to maintain the collars 30 on top of each other in substantially locking position to avoid oil leakage, although some oil leakage may still be acceptable compared to the amount being recovered. The joints 44 may be annular male-female (such as an annular ridge and groove), or rods and holes, and may be on the outside of the collars 30 or part of the tops 32*a*, 34*a* and bottoms 32*b*, 34*b* of the collars 30.

The length of the metal collar portion 32 relative to the length of the floatation portion 34 should be designed so the collars 30 are manageable in size and weight, yet still have a specific gravity greater than 1.00. In most applications the specific gravity should be less than approximately 1.10. In one application, the collars 30 should have a specific gravity between approximately 1.0 percent greater than the specific gravity of seawater and approximately 2.0 percent greater than the specific gravity of seawater. The metal collar portion 32 and the flotation portion 34 should have substantially circular transverse external cross-sections, and substantially circular transverse internal cross-sections. The floatation device 34 is to keep the specific gravity of a collar 30 slightly above the specific gravity of the water in which the pipe 7 resides, so the accumulated weight of the collars 30 is manageable. Since oil has a specific gravity less than that of seawater, the oil 9 will rise up through either the well casing 7 or collar 30 or both, and can be collected at the top of the column 40 of collars 30.

The metal collar portion 32 should be stainless steel, carbon steel, mostly stainless steel, or mostly carbon steel. The flotation portion 34 should be polyurethane, mostly polyurethane, or may comprise any suitable floatation material that is rigid or semi-rigid, and has a density sufficient to maintain the desired specific gravity of the collar 30 when combined with the metal collar portion 32.

Figure 4:
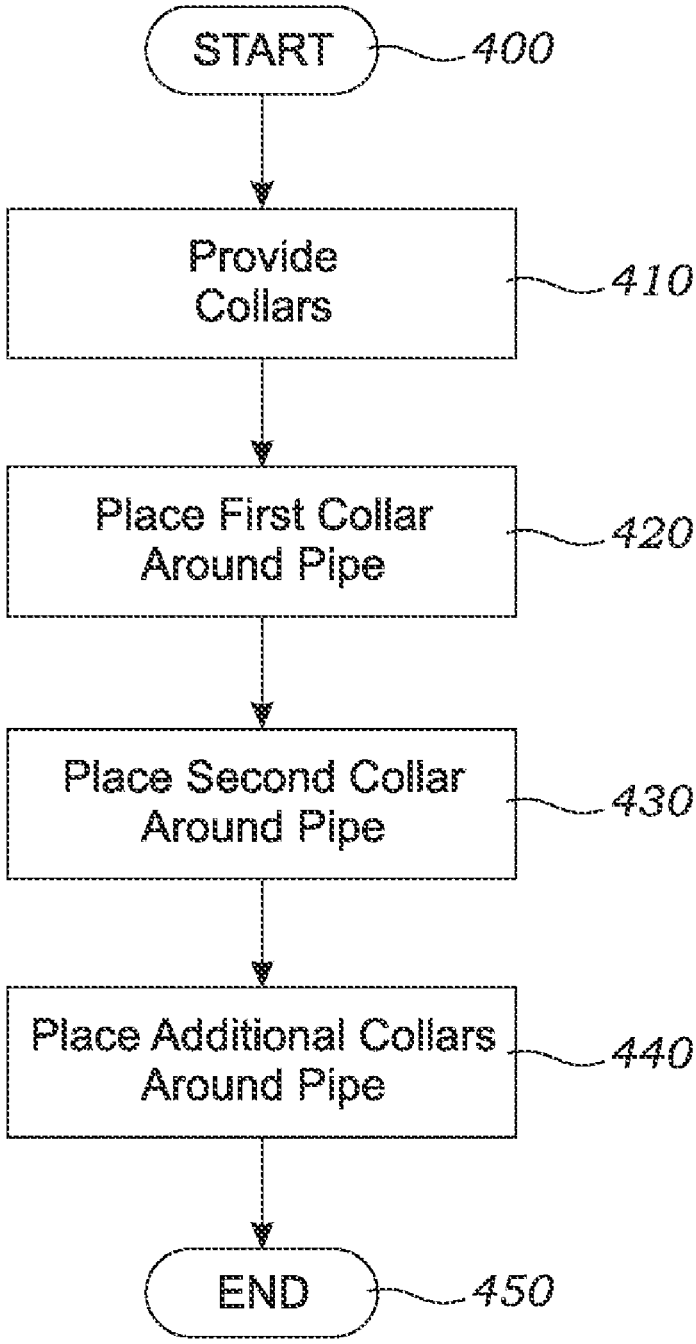
FIG. 4 is a flow diagram showing a method of using the exterior collars of FIG. 3 to control an underwater oil leak according to one embodiment of the present invention.

Turning now to FIG. 4, a flow diagram shows a method of using the exterior collars of FIG. 3 to control an underwater oil leak according to one embodiment of the present invention. The method begins at Step 400. At Step 410 the collars are provided. This may be simply having the collars present. At Step 420, a first collar is placed over or around the underwater oil well pipe such that the collar slides down a portion of the underwater oil well pipe. At Step 430 a second collar is placed over or around the pipe above the first collar such that the second collar comes to rest upon the first collar. The mechanical joint on the top of the first collar mates with the mechanical joint on the bottom of the second collar to form a column having a length of two collars. At Step 440, additional collars are likewise placed over or around the pipe in succession, each additional collar on top of the previously-placed collar such that each successive collar comes to rest upon the previously-placed collar, with the mechanical joint at the bottom of each successive collar mating with the mechanical joint at the top of the corresponding previously-placed collar to extend the length of the column of collars by one collar-length for each additional collar so placed.

In one embodiment, each of the collars 30 has a substantially identical specific gravity. The quantity of collars 30 placed over the pipe 7 should be sufficient to force the first collar 30 to a depth at or below the leak 8. In one embodiment, the first collar 30 is forced to the ocean floor 12 (or floor of whatever body of water in which the pipe 7 resides).

Systems and methods have thus been described for controlling underwater oil well leaks. These methods may be used independently, or combined with each other and/or with other methods, to help control oil leaks. Accordingly, embodiments are intended to exemplify alternatives, modifications, and equivalents that may fall within the scope of the following claims.

What is claimed is:

1. A method of controlling an underwater oil well leak from an underwater oil well pipe having a maximum diameter, the method comprising:

providing a plurality of heavy metal javelins; and placing the plurality of heavy metal javelins into an opening in the underwater oil well pipe;

wherein each of the plurality of heavy metal javelins has a proximal end and a tapered distal end;

wherein each of the plurality of heavy metal javelins has a length greater than the maximum diameter of the oil well pipe;

wherein the plurality of heavy metal javelins are placed into the opening distal-end first and;

wherein each of the plurality of heavy metal javelins is heavy enough to overcome upward forces of the oil.

2. The method of claim 1, wherein the plurality of heavy metal javelins comprise mostly lead.

3. The method of claim 1, wherein the length of the tapered distal end of each of the plurality of heavy metal javelins is between approximately one fourth and approximately one third the length of the proximal end.

4. The method of claim 1, wherein the maximum transverse diameter of each of the plurality of heavy metal javelins is between approximately 1.0 inch and approximately 1.5 inches.

5. The method of claim 1, wherein the maximum transverse diameter of each of the plurality of heavy metal javelins is between approximately one fifth the maximum diameter of the underwater oil well pipe and approximately one fourth the maximum diameter of the underwater oil well pipe.

6. The method of claim 1, wherein the opening is near the top of the underwater oil well pipe.

7. The method of claim 1, wherein the plurality of heavy metal javelins are dropped into the underwater oil well pipe.

8. The method of claim 7, wherein each of the plurality of heavy metal javelins are dropped into the underwater oil well pipe one at a time.

9. The method of claim 7, wherein the plurality of heavy metal javelins are dropped into the underwater oil well pipe until at least some of the plurality of heavy metal javelins come to rest at approximately the same level as the bottom of the pipe.

* * * * *